US010344475B1

(12) United States Patent
Alnakkar

(10) Patent No.: US 10,344,475 B1
(45) Date of Patent: Jul. 9, 2019

(54) LAYERED CEILING PANELS

(71) Applicant: USG Interiors, LLC, Chicago, IL (US)

(72) Inventor: Faris Alnakkar, Ontario (CA)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/956,781

(22) Filed: Apr. 19, 2018

(51) Int. Cl.
*E04B 9/00* (2006.01)
*E04B 9/04* (2006.01)

(52) U.S. Cl.
CPC ..... *E04B 9/001* (2013.01); *E04B 9/0464* (2013.01); *E04B 2103/06* (2013.01)

(58) Field of Classification Search
CPC ..... E04B 9/001; E04B 9/0464; E04B 2103/06
USPC ..... 52/22, 506.06, 506.07, 311.1, 407.2
See application file for complete search history.

(56) References Cited

U.S. PATENT DOCUMENTS 3,460,299 A * 8/1969 Wilson ..... E04B 9/303 181/286
4,175,360 A * 11/1979 Mulvey ..... E04B 9/0428 362/148
4,189,888 A * 2/1980 Blitzer, Jr. ..... E04B 9/04 52/311.1
4,709,308 A * 11/1987 Makino ..... B66B 11/0233 362/148
5,001,883 A * 3/1991 Landheer ..... E04B 9/0485 428/75
5,942,736 A * 8/1999 Cortonesi ..... E01F 8/0017 181/210
6,374,564 B1 * 4/2002 Fletterick ..... E04B 9/0407 52/506.07
6,397,531 B1 * 6/2002 Martin ..... E04B 9/0428 40/553
6,807,785 B2 * 10/2004 Lynch ..... B32B 3/266 52/39
7,051,489 B1 * 5/2006 Swiszcz ..... E04B 9/0442 160/84.05
7,658,046 B2 * 2/2010 Lynch ..... B32B 3/266 362/148
7,703,254 B2 * 4/2010 Alderman ..... E04B 9/001 428/68
RE45,851 E * 1/2016 Bodine ..... E04B 9/28
2003/0046890 A1 * 3/2003 Lynch ..... B32B 3/266 52/506.07
2015/0282269 A1 * 10/2015 Krall ..... H05B 33/0845 362/230

* cited by examiner

*Primary Examiner* — Joshua K Ihezie
(74) *Attorney, Agent, or Firm* — Pearne & Gordon LLP

(57) ABSTRACT

A suspended ceiling system having adjacent superposed suspended rectangular panels displaying a three-dimensional structure formed of elements existing primarily at two closely spaced horizontal planes, the system including a rectangular grid of bolt slot style grid members dividing the ceiling area into rectangular modules, lower panels and upper panels paired with the lower panels at the grid modules, the lower panels being formed of sheet metal having material removed to form individual open areas separated by residual sheet material and to provide a total open area of at least 10%, the upper panels having a variegated surface appearance when viewed through the open areas of the lower panels.

4 Claims, 2 Drawing Sheets

LAYERED CEILING PANELS

BACKGROUND OF THE INVENTION

The invention relates to suspended ceilings and, in particular, to a suspended ceiling system displaying a distinctive three-dimensional face.

PRIOR ART

Conventional suspended ceilings include a rectangular grid and opaque ceiling tiles or panels set in modules outlined by the grid elements or runners. It is known to construct suspended ceilings with sheet metal panels and planks that can be perforated for acoustical and/or aesthetic purposes. Architects and interior designers seek non-traditional ceiling constructions to offer a unique appearance with their creations. Factors to be considered in addition to uniqueness and visual impact, include functionality, product and installation costs, and durability.

SUMMARY OF THE INVENTION

The invention provides a novel suspended ceiling system with a unique and dramatic appearance. The construction is obtained by using a novel combination of generally known ceiling elements. The system involves the use of bolt slot style grid members or runners and separate, vertically spaced panels installed at each grid module. A lower panel, preferably of sheet metal, is attached to lower flange faces of the grid members. An upper panel is supported on upper surfaces of the grid member flanges. The lower panel is provided with apertures, distributed over its full face that, departing from ordinary constructions, are sufficiently large to reveal the downward facing surface of the upper panel. The downward facing or exposed surface of the upper panel has a visually variegated appearance so that a three-dimensional visual effect, including parallax phenomena is exhibited by the panels when viewed by an observer in a space below the ceiling.

The disclosed system affords an exponential number of appearance combinations available for selection by an architect or designer from a limited number of stock panel configurations and colors and an unlimited number of appearances where custom panel designs are available. Since the grid and basic panel types presently exist, tooling and related machinery and processes are available at minimal cost thereby making the system available at an affordable price. Installation techniques are standard and therefore cost effective.

DESCRIPTION OF THE PREFERRED EMBODIMENT

Figure 1:
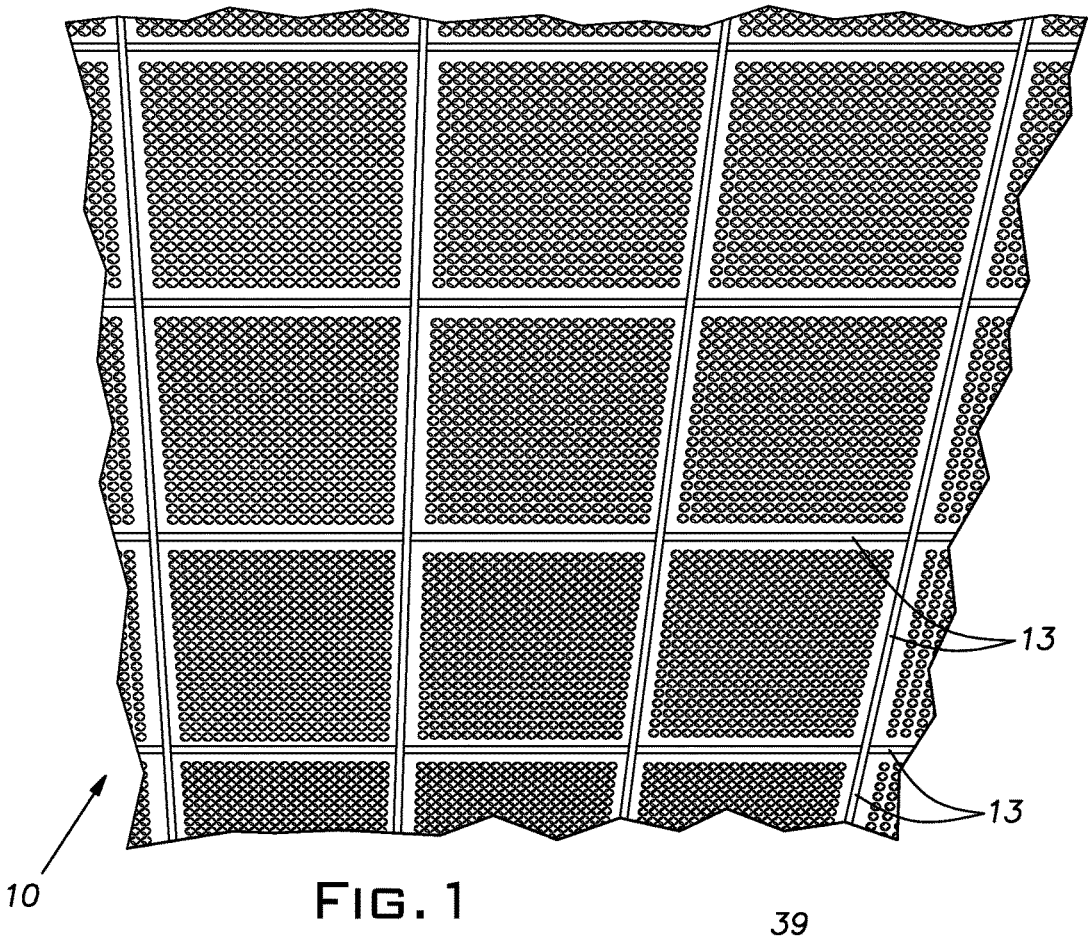
FIG. 1 is a fragmentary perspective view of a suspended ceiling system.
Figure 2:
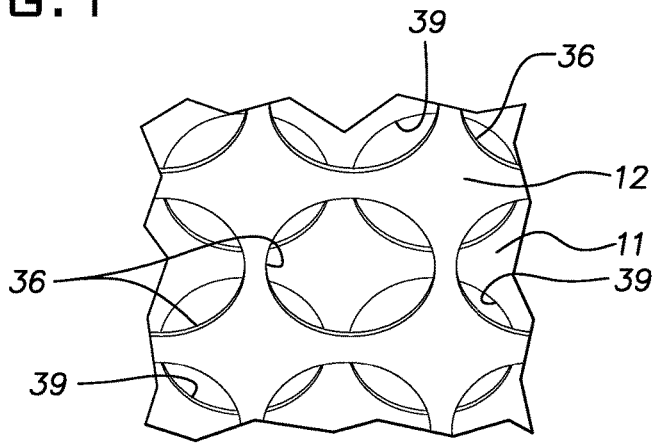
FIG. 2 is an enlarged, slightly indirect face view, taken from below the ceiling, of a small area of the ceiling system of FIG. 1.
Figure 3:
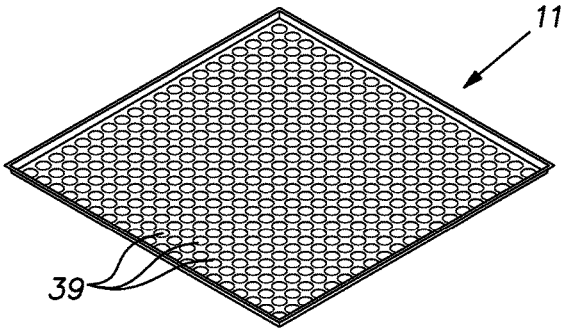
FIG. 3 is a perspective top view of a typical upper panel.
Figure 4:
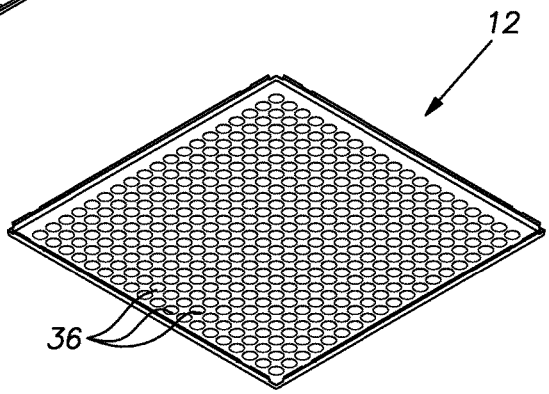
FIG. 4 is a perspective top view of a typical lower panel.
Figure 6:
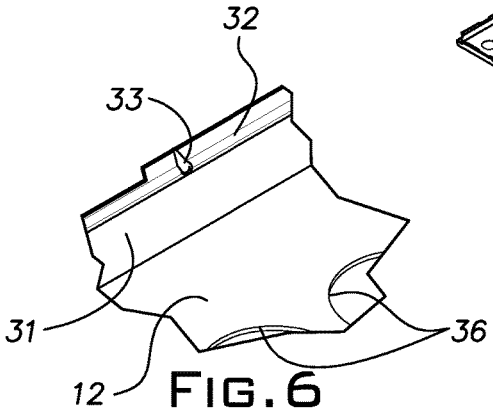
FIG. 6 is an enlarged view of a typical detent in a sidewall of the lower panel.
Figure 5:
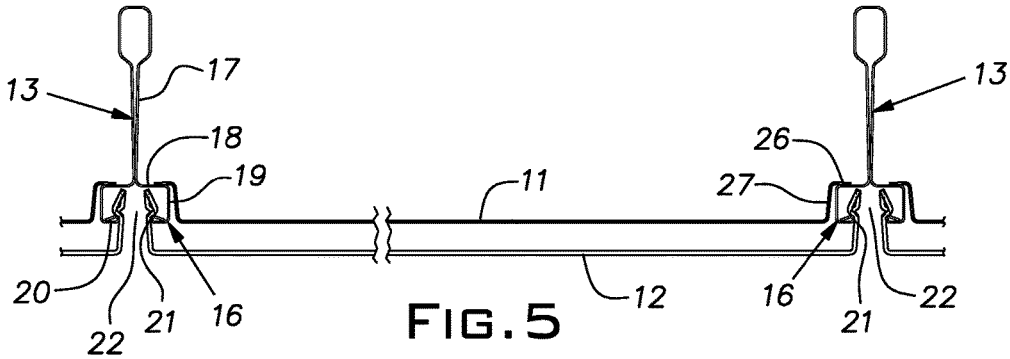
FIG. 5 is a cross-sectional view taken in a vertical plane through a grid module bounded by grid members.

FIG. 1 illustrates the visible face of a portion of a suspended ceiling system 10 constructed in accordance with the invention. FIG. 1 shows the ceiling to be indefinite width and length as indicated by the irregular boundary lines of the figure. Most of the ceiling face area visible from below comprises pairs of vertically spaced panels or tiles 11, 12 (FIGS. 2 and 5). A minor portion of the visible ceiling face is provided by the interior of bolt slot style grid tees or runners 13, shown in cross-section in FIG. 5. The grid runners 13, as is conventional, are arranged in a rectangular array or grid with main or through runners intersected by cross-runners. As is conventional, parallel, spaced main runners are suspended by wires or the like and the cross-runners have ends connected to adjacent main runners. The runners 13 divide the span of a ceiling into rectangular modules that are occupied by the panels 11, 12.

The suspended ceiling system 10 is characterized by the presence of the pair of panels 11, 12, one superposed over the other, in each grid module. The relationship of the panels 11, 12 to one another and to the grid runners 13 is illustrated in FIG. 5. The grid runners or members 13 are elongated elements and are typically formed of roll formed sheet metal. Ideally, the grid members 13 are of the bolt slot style having panel supporting flanges 16 on each side of a double wall central web 17. The flanges 16 are symmetrically arranged and have opposed C-shaped cross-sections.

The flanges 16, on each side of the runner 13 include an upper shelf part 18, a depending web 19 and a lower shelf part 20. Free or distal edges 21 of the lower shelf parts 20 are spaced from one another and form a gap 22, of one-quarter inch, for example, but not for limitation. The grid member 13 has a hollow reinforcing bulb along the upper edge of the central web 17.

The upper ceiling panel 11, in the illustrated case, is a shallow rectangular pan-shaped structure made of sheet metal, such as aluminum. The panel 11 has a narrow horizontal flange 26 and a generally vertical sidewall 27 along its perimeter. The flange 26 is vertically spaced above a plane of a main body of the panel 11. By way of example, the panel 11 can be fabricated from a sheet of aluminum having a thickness of between 0.021 inch to 0.040 inch, depending on size, for example. Where the size of the panel 11 is not substantially greater than 24 inches square, the panel can have an open area as much as 70%. Larger panels may be limited to an open area of 10% or less.

The lower panel 12 is a rectangular pan-shaped structure preferably made of sheet metal such as aluminum of a thickness between 0.032 inch to 0.040 inch, for example. A main generally planar body of the panel 12 has an integral vertical wall 31 along its full perimeter. The wall 31 has an embossed or stamped rib 32 extending inwardly along each panel edge and a set of horizontally spaced embossed cams or wedges 33 extending vertically above a respective length of rib 32. The panel 12 is proportioned so that the wall 31 at all four edges of the panel can be received in the gaps 22 of four associated grid members 13, and provide a slight interference fit with the flange edges 21. When the wall 31 is properly received in the gaps 22, the sections of the wall rib 32 with guiding assistance of the wedges 33 snap over the flange edges 21 and securely hold the panel 12 in place on the grid runners 13. As shown in FIG. 5, the upper panel 11 is superposed above the lower panel 12 in the same grid module with a vertical spacing of, for example, one-quarter inch.

More specifically, as shown in FIG. 5, the periphery of the upper panel 11 lies on the upper surfaces 18 of the grid member flanges 16 in a manner free of attachment to the lower panel 12, and spacing an upper panel main area inward of the periphery from the lower panel a distance substantially less than (i.e. not more than about ½) a distance from the lower panel planar face to the upper surfaces of the grid member flanges.

The sizes and perimeter structures of the panels 11 and 12 can be the same as with the PANZ® and CELEBRATION® metal panels, respectively, marketed by USG Corporation or its affiliates. By way of example but not limitation, the panels can have nominal planar dimensions of 1'×4', 1'×5', 2'×2', 2'×4', 2'×6', 2'×8', 4'×4', 20"×60", 30"×30" and 30"×60". Typically, but not necessarily, a ceiling will be assembled with identical upper panels and identical lower panels. The lower panel 12 has a multitude of openings 36 through and across its planar body to reveal the bottom face of the upper panel 11. These openings can be regular geometric shapes, i.e. the circular openings shown in FIG. 2, and/or irregular shapes, constant or varied in size, orientation and spacing. The total (collective) open area of the openings 36 may be limited, depending on the stiffness of the panel material so as to avoid excessive sag. Preferably, the panel open area of the collective openings 36 may range up to 70%. Ideally, the openings 36 are spaced from the perimeter of the planar body by, for example, one-quarter inch to permit drawing or stamping of the wall 31 without undue distortion of adjacent openings 36. Preferably, the open area of the lower panel is at least 10%.

A lower face of the upper panel 11 is visually variegated in the disclosed arrangement by the presence of a multitude of apertures 39 through the panel and distributed across substantially the full area of the panel. The apertures or holes 39 may, like those of the lower panel 12, be uniform or random in each of size, shape, orientation and location. The lower surface of the matrix area of the upper panel 11 surrounding the apertures 39 is visually distinct from the voids made by the apertures leaving the panel visually variegated. The total open area may be limited depending on the stiffness of the material of the panel 11, to avoid excessive sag. As shown in FIG. 5, the upper panel 11 is installed in a grid module so that the horizontal flange 26 rests on the upper shelf portion 18 of respective grid members.

With a ceiling installation completed, the lower faces of the upper panels 11 are visible through the open areas 36 of the associated lower panels 12. A person standing on a floor looking up at the ceiling, disposed at, for example, 8, 10 or 12 feet above the floor, with normal unassisted eyesight can observe a distinct three-dimensional effect presented jointly by the double panels 11, 12. Additionally, a parallax phenomena will be observed and will emphasize the three-dimensional effect when the observer moves his or her head. The surface elements remaining in the lower panel face, i.e. the part surrounding the apertures 36 will appear to move relative to the visible features on the lower side of the upper panel 11.

Where both the upper and lower panels 11, 12 are apertured, a light source in the plenum above the ceiling can direct light downwardly through the panels. Additionally, air can be circulated through the panels. A color filter for light passing down through the ceiling can be disposed on one or both of the panels 11, 12 and, alternatively, a sound absorbing layer can be disposed on the upper side of the upper panel 11.

A conventional acoustical ceiling panel, not having visible through holes can be used as an upper panel 11. Preferably, the lower face of such panel is sufficiently visually variegated in surface contour or texture and/or in color contrast to exhibit a parallax phenomena when observed through the apertures in the lower panel 12.

The panels 11, 12 are physically independent of one another, enabling them to be separately installed, to individually adjust to any deviations of the grid members from a true plane, and to be separately removed from the grid for cleaning or replacement, for example.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling system having an expanse of closely adjacent superposed suspended rectangular panels displaying a three-dimensional structure formed of elements existing primarily at two closely spaced horizontal planes, the system including a rectangular grid of bolt slot style grid members dividing the ceiling area into rectangular modules, lower panels and upper panels paired with the lower panels at the grid modules, the lower panels having peripheral edges releasably retained in bottom slots of the grid members and the upper panels having peripheries resting on upper surfaces of C-shaped grid member flanges, the upper panels being free of attachment to the lower panels, the lower panels being formed of sheet metal with planar faces having material removed to form individual open areas separated by residual sheet metal material and to provide a total open area of at least 10% of said planar faces, the upper panels having a variegated surface appearance when viewed, by a person standing on a floor not greater than 12 foot below the ceiling system, through the open areas of the lower panels, the periphery of the upper panel lying on the upper surfaces of the grid member flanges in a manner free of attachment to the lower panel, and an upper panel main area inward of the periphery is spaced from the lower panel a distance substantially less than a distance from the lower panel planar face to the upper surfaces of the grid member flanges, whereby the upper and lower panels together exhibit a three-dimensional face.

2. A ceiling system as set forth in claim 1, wherein the lower panel planar face has a total open area of between 10% and 70%.

3. A ceiling system as set forth in claim 1, wherein the upper panel main area has a total open area of 10% to 70%.

4. A ceiling system as set forth in claim 1, wherein the upper panel is an acoustical panel free of visual apertures extending through the thickness of the panel.

* * * * *